US006767151B1

(12) United States Patent
Owens

(10) Patent No.: US 6,767,151 B1
(45) Date of Patent: Jul. 27, 2004

(54) DISPENSER/SPREADER ARTICLE FOR SPACKLING AND PASTE

(76) Inventor: Richard L. Owens, 3213 Woodhaven Ct., Conyers, GA (US) 30094

( * ) Notice: Subject to any disclaimer, the term of this patent is extended or adjusted under 35 U.S.C. 154(b) by 0 days.

(21) Appl. No.: 10/421,453

(22) Filed: Apr. 22, 2003

(51) Int. Cl.[7] ..... B05C 11/00
(52) U.S. Cl. ..... 401/266; 401/262
(58) Field of Search ..... 401/261, 262, 401/264, 265, 266; 222/107; 206/216, 229, 461, 469

(56) References Cited

U.S. PATENT DOCUMENTS

| | | | | |
|---|---|---|---|---|
| 708,709 | A | | 9/1902 | Henneberry et al. |
| 817,890 | A | | 4/1906 | Williams |
| 1,122,006 | A | | 12/1914 | Keller |
| 1,427,411 | A | | 8/1922 | Payne |
| 1,882,770 | A | | 10/1932 | Bugg |
| 2,197,579 | A | | 4/1940 | Hooper |
| 2,624,901 | A | | 1/1953 | Wiley |
| 2,772,432 | A | | 12/1956 | Andreola |
| 2,804,767 | A | | 9/1957 | Schoen |
| 2,864,108 | A | | 12/1958 | Johnson |
| 2,876,782 | A | | 3/1959 | Hudgens |
| 2,930,061 | A | | 3/1960 | O'Neil |
| 2,930,063 | A | | 3/1960 | Stull |
| 2,943,338 | A | | 7/1960 | Lowen |
| 2,982,987 | A | | 5/1961 | Knapp |
| 3,090,071 | A | | 5/1963 | Brooy |
| 3,192,555 | A | | 7/1965 | Nyden |
| 3,368,234 | A | | 2/1968 | Edens, Jr. |
| 3,482,920 | A | | 12/1969 | Schwartzman |
| 3,486,666 | A | | 12/1969 | Herzig et al. |
| 3,782,600 | A | | 1/1974 | Columbus |
| 4,127,339 | A | | 11/1978 | Malacheski et al. |
| 4,218,155 | A | | 8/1980 | Weidner |
| 4,225,058 | A | | 9/1980 | Morton et al. |
| 4,323,175 | A | | 4/1982 | Eckert |
| 4,470,521 | A | * | 9/1984 | Scammell ..... 222/107 |
| 4,648,506 | A | | 3/1987 | Campbell |
| 4,836,341 | A | | 6/1989 | Hall, III |
| 4,854,760 | A | | 8/1989 | Pike et al. |
| 4,921,137 | A | | 5/1990 | Heijenga |
| 4,963,045 | A | | 10/1990 | Willcox |
| 5,046,877 | A | | 9/1991 | Longo |
| 5,111,932 | A | | 5/1992 | Campbell |
| 5,180,244 | A | | 1/1993 | Hirose |
| 5,199,808 | A | | 4/1993 | Gueret |
| D356,259 | S | | 3/1995 | Hoyt |
| 5,415,488 | A | | 5/1995 | MacGibbon et al. |
| D363,377 | S | | 10/1995 | Koptis |
| 5,577,851 | A | | 11/1996 | Koptis |
| D387,563 | S | | 12/1997 | Koptis |
| 5,788,123 | A | | 8/1998 | Hackmann et al. |
| 6,007,264 | A | | 12/1999 | Koptis |
| D449,987 | S | | 11/2001 | Owens |
| 6,415,939 | B1 | | 7/2002 | Redmond |
| D462,614 | S | | 9/2002 | Owens |

* cited by examiner

*Primary Examiner*—Tuan N. Nguyen
(74) *Attorney, Agent, or Firm*—Price Heneveld Cooper DeWitt & Litton

(57) ABSTRACT

A spreader includes a resilient sheet and a deformable sheet bonded together and shaped to form a blister-shaped sealed container filled with spackling material. The resilient sheet forms an enlarged blade at one end suitable for spreading the spackling material and forms an opening at the one end for dispensing the spackling material onto the blade. A hole in the other end forms a docking station. A resilient plug fits in the opening to seal the opening to maintain the spackling material for later use, and is repositionable into the docking station for holding the plug while using the spreader. The container is suitably sized for grasping and manipulating the blade while dispensing material from the container.

30 Claims, 2 Drawing Sheets

DISPENSER/SPREADER ARTICLE FOR SPACKLING AND PASTE

BACKGROUND

The present invention relates to a dispenser/spreader article for applying and spreading paste materials, such as spackling, pastes, adhesive and other viscous materials as defined below.

For possibly centuries, holes and imperfections in walls have been repaired using a scraping/spreading implement and a filling, repair substance. A modern tool of choice is, of course, a metal "putty knife", which is generally resilient and about 1 to 6 inches wide. Typically, a worker scoops out a quantity of spackling material from a container using the tool, and applies the spackling material directly to a wall. For this process to work properly, the nature of spackling material in containers requires it to be more solid than liquid, but also requires that the spackling material be pasty/sticky and not too dry. At the same time, the spackling material must preferably dry quickly, so that subsequent finishing operations, such as sanding, can be completed soon after application. Disposal of unused spackling is messy and wasteful. At the same time, it is typically undesirable to put excess spackling material back into a tub because the excess spackling material can taint the whole tub with fuzz, hair, dirt, and of course, mostly-dry spackling material. When a tub runs low of material, such as at the end of a job, the material in the tub tends to dry out and/or get debris in it, such that it then contains mostly unusable spackling material, which ultimately ends up going into the trashcan. It is fair to say that the above repair method is very often quite wasteful.

Spackling materials are especially difficult to deal with since they are more viscous and more prone to drying and clumping than many creams and adhesives/caulking compounds. Further, spackling materials (by design) tend to dry quickly and skin over and/or form crusts or cake-like clumps that render the material difficult to apply. Thus, spackling materials are notorious for not flowing well through long or narrow channels. This makes sense since the spackling materials are intended to plug up and cover holes, cracks, and crevices. However, this property makes dispensing of spackling materials more difficult.

One proposed method to improve the process of applying spackling materials is to use a collapsible tube filled with diluted spackling material. These tubes have long narrow spouts which are to be cut to allow the spackling to be dispensed wherever desired by squeezing the tube and applying directly to the crack or nail hole, or by placing the dispensing spout directly at the best spot on the blade. Excess spackling can then be wiped off with a putty knife, leaving a nice smooth surface. A problem is that the long narrow spouts require diluted spackling material so that the spackling material can be dispensed through the long narrow passageways of the spouts. As a result, the diluted low-viscosity spackling doesn't work well on larger holes and cracks, since it sags and/or shrinks unacceptably upon drying.

Another effort at improving the repair process was recently introduced by the Dap Company as the Patch Stick® product. This product utilized a "push-up" tube as the dispensing device. Push-up tubes dispense by turning a knob clockwise at the bottom, which forces a plunger inside to move upward, thus forcing the material inside to exit out the opposite open end. A very desirable feature of push-up tubes is that twisting counterclockwise can "suck back" some of the dispensed material. Push-up tubes have been used for years with solid underarm deodorant, glue, lip balm, lipstick, sun block, solid pre-wash stain treatments, etc. However, push-up tubes are expensive since they require uniquely shaped parts with tight tolerances that interact to provide the push-up action. Also, the cap spreader of the tube is awkward to hold and is not necessarily optimally shaped for use as a firm grip when spreading spackling material. Further, material that is sucked back into the tube can be contaminated, leading to problems at a time when the consumer expects to be able to reuse the product, causing frustration of the worker/user. The Patch Stick® instructions suggest removing its tall hollow cap, twisting the bottom to dispense some spackling from the top, rubbing the spackling onto the hole or crack, and scraping off excess material with the cap. Alternatively, the cap can be used to scrape off spackling from the tube and then apply the dispensed material to the wall. This system works very similarly to the collapsible tube method previously described, but has the advantage of the tube being rigid. Moreover, when the collapsible tube is almost empty, the collapsible tube is more difficult to grip than the stiff-sided push-up tube. This leads to substantial waste, since partially-filled collapsible tubes are discarded.

A serious problem with the Dap Patch Stick® product that was tested, is that, as the spackling material is dispensed and used, the spackling tends to become drier and therefore less cohesive. Upon close examination, it was discovered that the seal at a rear end of the tube fits snugly and rather airtight only when the tube is full. When partially emptied, air enters into the space behind the plunger and allows drying of the spackling. Another source of moisture loss is at the top where the "seal" is not bonded, but merely lying on the spackling material. This allows the air in the hollow cap to dry the exposed spackling material. Drier spackling material tends to crumble, lose its plastic nature, and not adhere properly to the wall or spreader cap.

The prior art that combined a spreader blade with a material supply of paste that I, the inventor, investigated included one or more of the following negative features: 1) a narrow or long channel that was not well-suited for nor usable for dispensing spackling or adhesive paste; 2) an obstruction to the dispensing hole or dispensing area that impedes or prevents wiping the dispensing area clean for subsequent later use of the apparatus; 3) no plug or seal that adequately prevents material at the dispensing site from drying out; 4) no docking location for any such plug, nor for convenient storage of a sealing plug so that it does not get lost while using the apparatus; 5) prior art uses a cylindrical tube which requires or includes a long dispensing channel and which does not provide an ergonomic handle; 6) no straight, smooth scraping edge with squared or relatively-sharp corners to facilitate application of the spackling material to concave edges and corners; 7) no resilient blade that does a good job of simulating a putty-knife blade with proper memory and resiliency of the blade; and 8) prior art tends to be limited to a single use only due to drying of spackling material around the dispensing location or due to contamination (i.e. dust, debris, insect remains, etc.) of spackling material sucked back or back-mixed with the spackling material in the apparatus.

Accordingly, an automated apparatus is desired that provides the advantages noted above and that solves the disadvantages.

SUMMARY OF THE PRESENT INVENTION

In one aspect of the present invention, an article includes a spreader with a sealed container forming a blade at one end and having a dispensing opening for dispensing paste material from the container onto the blade and still further including a docking structure remote from the dispensing opening, the sealed container being adapted to be filled with the paste material and to dispense the paste material therefrom onto the blade. The article further includes a removable plug shaped to sealingly engage the opening, and further shaped to engage the docking structure for storage while the article is being used to apply and spread the paste material with the blade.

In another aspect of the present invention, an article includes a spreader comprising a resilient sheet and a deformable sheet bonded together and shaped to form a blister-shaped sealed container therebetween, with the sealed container being adapted to contain spackling material. The resilient sheet forms a blade at one end suitable for spreading the spackling material and further forms an opening at the one end for dispensing the spackling material onto the blade. A docking station formed on the resilient sheet replicates the opening and is located away from the blade and opening, so that the docking station is adapted to hold a plug for the opening on the spreader without interfering with dispensing spackling material onto the blade and without interfering with using the article including the blade.

In another aspect of the present invention, an article includes a resilient sheet and a deformable sheet bonded together to form a blister-shaped container, with the resilient sheet having an enlarged blade formed at one end and a dispenser hole also formed at the one end for dispensing material from the container onto the blade. A plug is provided that is shaped to fit sealingly into the dispenser hole to maintain an airtight seal of the container. The plug is also shaped to fit into the holder hole for storage while using the article to spread a substance dispensed from the container.

In yet another aspect of the present invention, an article includes a resilient sheet and a deformable sheet bonded together to form a blister-shaped container. The resilient sheet has a first section forming part of the container with a first width, and further has a second section with a second width larger than the first width that forms an enlarged blade for spreading material dispensed from the container. The second section further includes a dispenser hole also formed at the one end for dispensing material from the container onto the blade.

In still another aspect of the present invention, an article includes a resilient sheet and a deformable sheet bonded together and shaped to form a plurality of blister-shaped sealed containers therebetween. The containers each include a wide end and a narrow end. Paste material, sensitive to drying or curing upon exposure to atmosphere, fills each of the containers. The resilient sheet includes an opening in the enlarged end of each of the containers for dispensing the paste material onto the enlarged end, and includes a docking station in the narrow end shaped to simulate the opening and that is located remotely from the enlarged end and the opening. By this arrangement, a plug for the opening can be held by the docking station on each individual spreader without interfering with dispensing paste material onto the enlarged end and without interfering with using the enlarged end to spread the paste material.

In a narrower aspect, the resilient sheet defined above is partially die-cut to define a plurality of individual dispenser/spreader articles from the bonded deformable and resilient sheets, with the separable dispenser/spreader articles each including one of the blister-shaped scaled containers and each further including a wide end forming a blade and a narrow end forming part of the sealed container. The wide end of each adjacent separable article is located near the narrow end on the adjacent separate article to provide a dense arrangement of articles on the deformable and resilient sheets prior to separation.

My testing and experimentation has found that an apparatus providing the following characteristics would be very desirable. Accordingly, it is an object of the present invention to include one or more or all of the following characteristics: 1) simple, one-handed operation; 2) a resilient blade similar to the feel of a steel putty knife; 3) economical to make and use; 4) disposable; 5) airtight to preserve plasticity and fluidity of the spackling material; 6) no unacceptably small channel or restriction through which the heavy-bodied spackling and adhesive pastes must be forced; 7) straight edged blade with 90° corners; 8) reusable plug that is dockable on the device; and 9) use of the device should leave the repaired hole area smooth and unblemished, not needing to be sanded.

These and other aspects, objects, and features of the present invention will be understood and appreciated by those skilled in the art upon studying the following specification, claims, and appended drawings.

DETAILED DESCRIPTION OF PREFERRED EMBODIMENTS

In the discussion below, "paste" is a soft, moist, smooth-textured substance that will hold its shape when applied to vertical surfaces, without distortion due to gravity. "Blister" is intended to define a bulging, bubble-like shell, with side flanges spread outward to define a plane. "Channel" defines a tube-like, elongated passage for fluid or flowable material. "Plastic" is a polymeric material capable of being molded and changed in shape. "Spackling" is a paste usable for filling holes and cracks in walls and ceiling without distortion due to gravity. "Adhesive" is a material, which will bond to vertical surfaces, without distortion due to gravity. "Thermoplastic" is a material that becomes soft and moldable when subjected to heat.

Figure 4:
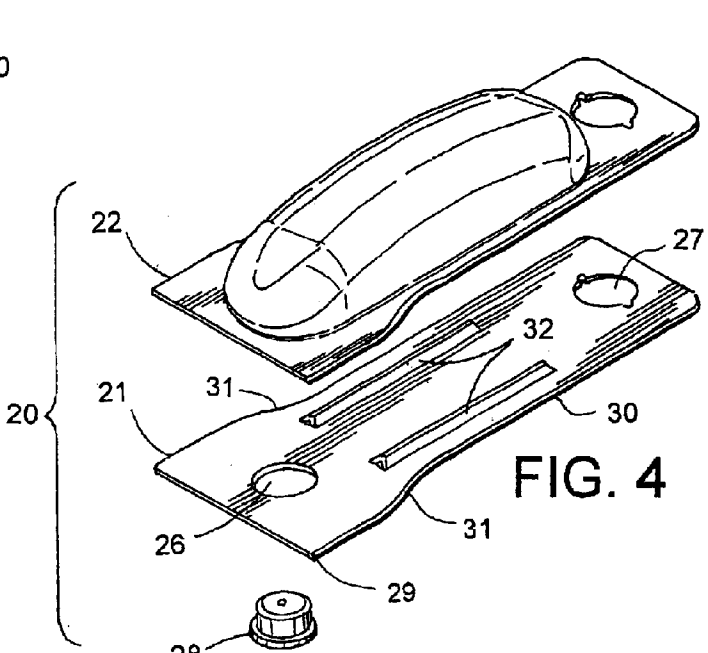
FIG. 4 is an exploded perspective view of FIG. 1.
Figure 3:
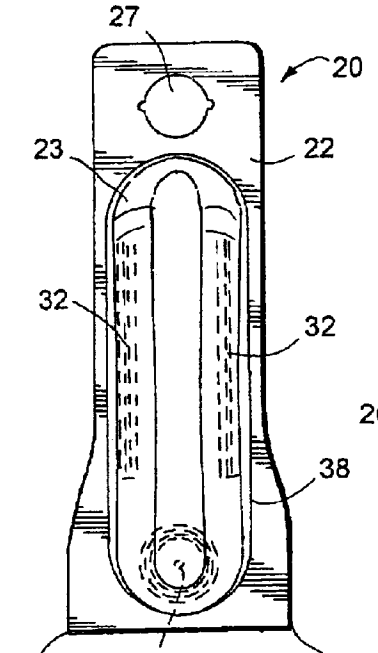
FIGS. 1–3 are perspective, side, and top views of a dispenser/spreader article embodying the present invention.
Figure 2:
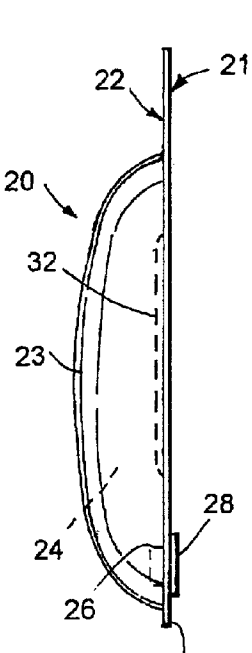
Figure 6:
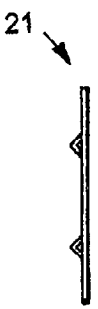
FIGS. 5–6 are top and end views of the resilient sheet shown in FIG. 4.
Figure 5:
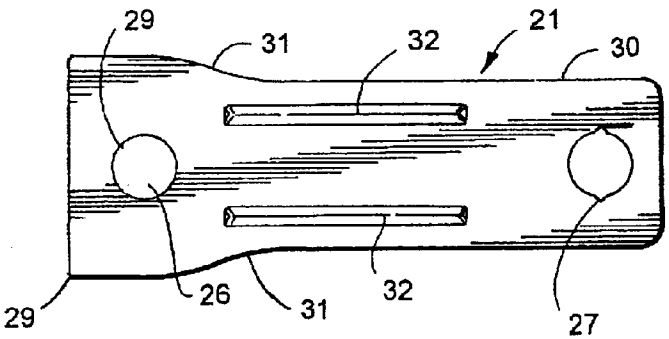
Figure 1:
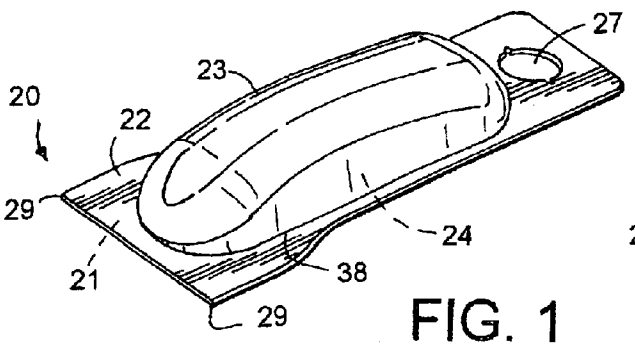
Figure 7:
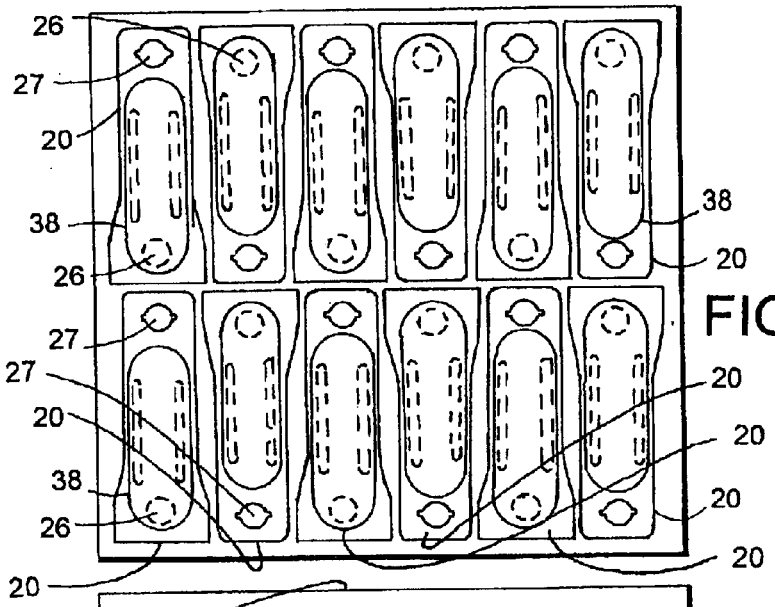
FIG. 7 is a plan view of two bonded sheets forming a plurality of the dispenser/spreader articles shown in FIG. 1 prior to separation into individual dispenser/spreader articles.

A spreader/dispenser article 20 (FIGS. 1–4) includes a resilient sheet 21 (often called "stiff sheet" in the PVC industry) (FIG. 4) and a deformable sheet 22 (often called "flexible sheet" in the PVC industry) bonded together and shaped to form a blister-shaped blister-like sealed container 23 filled with paste material 24, such as spackling material, adhesive, airdrying and/or air-sensitive materials. The resilient sheet 22 forms an enlarged blade 25 at one end suitable for spreading the spackling material 24 and forms an opening 26 at the one end for dispensing the spackling material 24 onto the blade 25. A hole 27 in the other end forms docking station spaced from the opening 26. A hollow resilient plug 28, having a "top hat" shape, is positionable in the opening 26 to seal the opening 26 to keep the spackling material 25 from drying so that it is good for later use. The plug 28 is removable and can be repositioned in the docking station hole 27 for storing/holding the plug 28 while a worker is using the spreader/dispenser article 20. The portions of the sheets 21 and 22 forming the container 23 and the area around the container 23 are suitably sized for grasping and manipulating the blade 25 while squeezing and dispensing material 24 from the container 23.

The resilient sheet 21 (FIG. 4) has properties optimally chosen to replicate the flexibility and resiliency of spring steel, such as the spring steel of a blade on a putty knife. Workers have surprisingly strong preferences concerning a strength and flexibility of their putty knives, and the present arrangement is well-suited to meet that demand. Sheet 21 can be substantially any desired bendable material. However, in a preferred form, it has been found that "rigid" PVC material having a thickness of about 0.020 to 0.040 inches (or more preferably 0.020 to 0.030 inches, or most preferably about 0.030 inches) and a relatively high durometer works well for the intended purpose. The handle-forming narrow end 30 of the sheet 21 is about 2¼ inches wide, while the blade end can be any width desired such as about 3 inches wide. The leading edge of the illustrated blade is linear and straight, but it is contemplated that it can be serrated or another shape, if desired. It is preferable that the blade 25 have relatively sharp 90° corners 29 so that workers can use the blade 25 to smooth out areas found near interior wall corners, and around window casings, when using spackling material. It is also preferable that the blade 25 have a length that extends past the dispensing opening 26, and further that it include angled edges 31 that transition to the handle-forming narrow end 30 so that the blade 25 flexes and bends in a way most desirable to a worker using the article 20.

The dispenser opening 26 is preferably wide enough to prevent undue and undesirable restriction of spackling material as it exits the container 23. It is contemplated that the opening 26 should be at least about 7/16 inch in diameter for spackling materials, and more preferably is at least about ⅝ to 1 inch in diameter, and most preferably about ¾ to 13/16 inch in diameter. The hole 27 forming the docking station has a similar size, so that the plug 28 can be easily pressed into the hole 27 for secure storage while using the article 20. The illustrated hole 27 includes notches 31 to facilitate merchandising (i.e. to facilitate hanging the article 20 on a single or double prong J hook, as is often used in a retail store) and to facilitate inserting and removing the plug 28. Parallel stiffening ribs 32 extend along the side of the narrow end 30, slightly inboard of the lines of bonded material forming edges of the container 23. The stiffening ribs 32 allow a thinner sheet of material 21 to be used, thus helping keep the sheet 21 closer in thickness to the sheet 22, which has advantages for RF bonding the two sheets 21 and 22 together, as discussed below.

The deformable sheet 22 (FIG. 4) comprises a sheet of "flexible" PVC having a thickness as close to that of resilient sheet 21 as possible, to facilitate bonding the two sheets 21 and 22 together. The reason that same or similar thickness of sheets 21 and 22 is preferred is believed to be due to thermal and physical movement of material in the two sheets 21 and 22 during the bonding process of RF, sonic, or vibrational bonding processes. It is contemplated that the deformable sheet 22 is preferably at least about 0.007 to 0.020 inches thick, and more preferably between at least about 0.012 to 0.015 inches thick or slightly more. The thickness of deformable sheet 22 is of course dependent upon the bonding technique used to bond the sheets 21 and 22 together, and also is dependent upon the feel that the manufacturer desires to give to the end user. It is contemplated that a number of different bonding techniques can be used, such as radio-frequency (RF) bonding, heat bonding, vibrational and/or sonic bonding, adhesive bonding, sheet-to-sheet material bonding (such as by use of an evaporative solvent), and the like. In a preferred mode, RF bonding or sonic welding is preferred. Where the sheets 21 and 22 are both of the same type material, such as PVC material, and have a similar thickness, such as 0.012 to 0.015 inches for the deformable sheet 22 and 0.020 to 0.030 inches for the rigid sheet 21, the sheets 21 and 22 are more easily bonded using RF bonding techniques.

Container 23 is optimally sized and shaped for grasping. by the palm of a worker's hand, so that the material 24 is dispensed with a full hand squeeze (rather than a finger-only squeeze). In the illustrated arrangement, the container 23 is slightly under 2 inches wide, such as about 1.88 inches wide, with thin strips of material being left on each side of the container 23 on the narrow end 30. Further, the handle-forming end is about 5 to 6 inches long, while the blade end 25 is about 2 to 3 inches long.

The plug 28 (FIG. 4) is a resilient hollow member that is thimble-shaped or hat-shaped. The plug 28 is made of resilient vinyl or the like for good flexibility and good sealing ability, and includes a rim 33 that assists in grabbing it to remove it from dispensing opening 26 and/or from the docking station hole 27.

Figure 8:
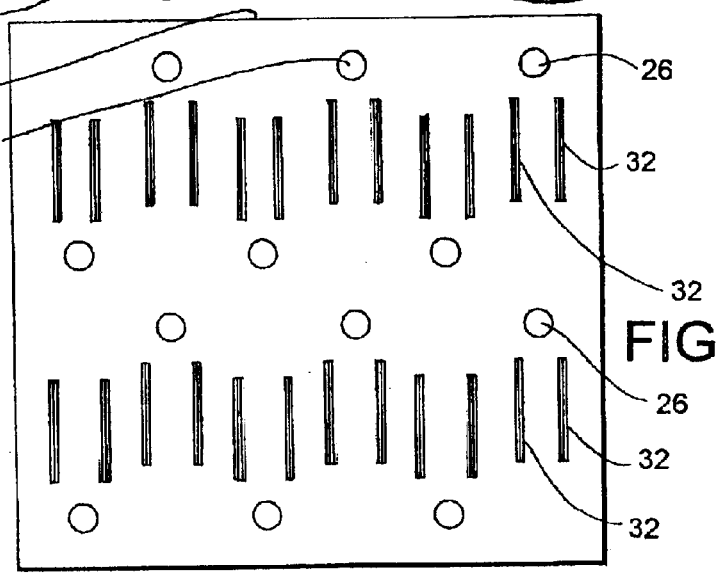
FIGS. 8–9 are plan views of a die-cut resilient sheet of material (FIG. 8) and of a thermoformed deformable sheet of material (FIG. 9), which are preformed and then bonded together to form the bonded sheets of FIG. 7.
Figure 9:
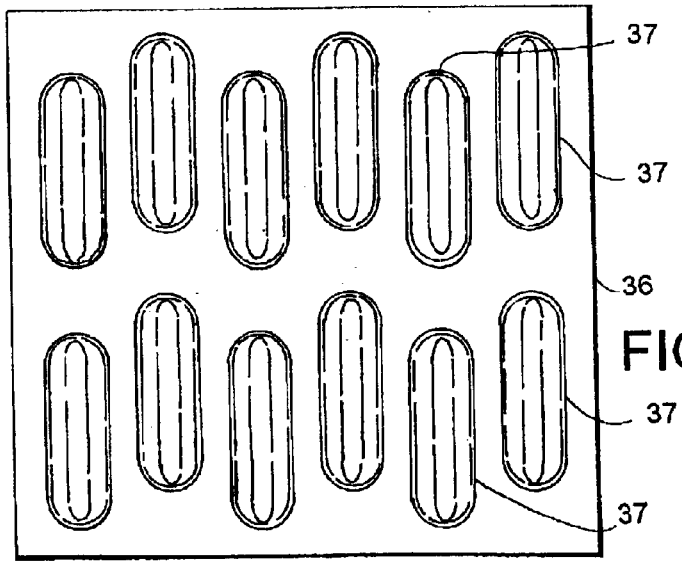

In a preferred method, the articles 20 are mass-produced by making several on a two-sheet laminate as follows. A first sheet of "rigid" resilient material 35 (FIG. 8) is die-cut and formed to include dispensing openings 26 and includes parallel ribs 32 for several articles 20. The illustrated sheet 35 is die-cut and formed to make twelve articles 20 (more or less could be formed, if desired). The second sheet of deformable material 36 (FIG. 9) is thermally formed to include twelve blisters 37 that correspond to the locations on the sheet 35. The two sheets 35 and 36 are then sandwiched together, and are bonded together along oblong weld lines 38. The assembled sheets 35/36 are then cut to include the holes 27 for the docking stations, and are further cut (potentially in the same die-cutting operation) to include the enlarged end forming the blade 25. Optimally, the blades 25 in each adjacent article 20 on the sheet are at opposite ends so that a maximum density of articles 20 can be formed on each sheet.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. An article comprising:

a spreader including a sealed container forming a blade at one end and having a dispensing opening for dispensing paste material from the container onto the blade and still further including a docking structure remote from and opposite the blade, the sealed container being adapted to be filled with the paste material and for dispensing the paste material therefrom; and a removable plug shaped to sealingly engage the opening, and further shaped to engage the docking structure for storage while the article is being used to apply and spread the paste material with the blade.

2. The article defined in claim 1, wherein the docking structure for the plug is located at an end opposite the blade.

3. The article defined in claim 2, wherein the docking structure includes a hole that is about the same size as the dispensing opening.

4. The article defined in claim 2, wherein the hole includes side notches to facilitate receipt of a J hook for merchandising displays.

5. The article defined in claim 1, wherein the spreader includes at least one side that is deformable and collapsible.

6. The article defined in claim 5, wherein the spreader includes a deformable sheet of material forming a blister-like, deformable side of the container.

7. The article defined in claim 1, wherein the spreader includes a relatively resilient sheet of material forming a side of the container and also forming the blade.

8. The article defined in claim 7, wherein the opening is formed in the resilient sheet.

9. The article defined in claim 8, wherein the resilient sheet comprises a "rigid" PVC material.

10. The article defined in claim 9, wherein the spreader includes a second sheet of material attached to the resilient sheet to form the container.

11. The article defined in claim 10, wherein the second sheet is blister-shaped and comprises a deformable sheet.

12. The article defined in claim 11, wherein the resilient sheet and the deformable sheet are individually each between about 0.012 inches and 0.030 inches in thickness.

13. The article defined in claim 7, wherein the blade is formed at an enlarged end of the resilient sheet.

14. The article defined in claim 13, wherein the blade has relatively sharp 90° corners and a straight edge therebetween.

15. The article defined in claim 7, wherein the resilient sheet includes stiffening ribs that extend along but are spaced inwardly from edges of the resilient sheet.

16. The article defined in claim 15, wherein the stiffening ribs include at least two parallel stiffening ribs.

17. The article defined in claim 15, wherein the resilient sheet and the second sheet are attached together by continuous bonded strip of material and characteristically without addition of material separate from the rigid and second sheets.

18. The article defined in claim 1, wherein the plug extends into the opening and flexes outwardly to sealingly engage marginal material forming the opening.

19. The article defined in claim 1, wherein the opening is at least about 7/16 inch in diameter.

20. An article comprising:

a spreader including a resilient sheet and a deformable sheet bonded together and shaped to form a blister-shaped sealed container therebetween, the sealed container being adapted to contain spackling material; the resilient sheet forming a blade at one end suitable for spreading the spackling material and forming an opening at the one end for dispensing the spackling material onto the blade, and including a docking station shaped like the opening that is located away from and opposite the blade and opening, so that a plug for the opening can be held on the spreader without interfering with dispensing spackling material onto the blade and without interfering with using the article including the blade.

21. The article defined in claim 20, including a removable, resilient plug shaped to sealingly engage and close the opening.

22. The article defined in claim 21, wherein the docking station is located at an end opposite the blade.

23. The article defined in claim 22, wherein the docking station includes a hole.

24. The article defined in claim 20, wherein the resilient sheet and the deformable sheet each individually include a thickness between about 0.012 inches and about 0.030 inches.

25. The article defined in claim 20, wherein the opening is at least 7/16 inch in diameter.

26. The article defined in claim 20, wherein the resilient sheet includes at least two parallel ribs that extend toward the blade.

27. An article comprising:

a resilient sheet and a deformable sheet bonded together to form a blister-shaped container, the resilient sheet having an enlarged blade formed at one end and a dispenser hole also formed at the one end for dispensing material from the container onto the blade, wherein the resilient sheet includes an opposite end that is positioned opposite the one end and includes a holder hole;

a plug shaped to fit sealingly into the dispenser hole to maintain an airtight seal of the container and shaped to fit into the holder hole for storage while using the article to spread a substance dispensed from the container.

28. An article comprising:

a resilient sheet and a deformable sheet bonded together to form a blister-shaped container, the resilient sheet having a first section forming part of the container and that has a first width, and having a second section with a second width larger than the first width that forms an enlarged blade for spreading material dispensed from the container, the second section further including a dispenser hole also formed at one end for dispensing the material from the container onto the blade, wherein the resilient sheet includes an opposite end that is positioned opposite the one end and includes a holder hole; and a plug shaped to fit sealingly into the dispenser hole to maintain an airtight seal of the container, and shaped to fit into the holder hole for secure storage while using the article to spread a substance dispensed from the container.

29. An article comprising:

a resilient sheet and a deformable sheet bonded together and shaped to form a plurality of blister-shaped sealed containers therebetween, the containers each including a enlarged end and a narrow end;

paste material sensitive to exposure to atmosphere fills each of the containers;

the resilient sheet including an opening in the enlarged end of each of the containers for dispensing the paste material onto the enlarged end, and including a docking station in the narrow end shaped to simulate the opening and that is located remotely from and apposite the enlarged end and the opening, so that a plug for the opening can be held on thereon the narrow end without interfering with dispensing paste material onto the enlarged end and without interfering with using the article including the enlarged end.

30. The article defined in claim 29, wherein the resilient sheet is partially die-cut to define a plurality of individual dispenser/spreader articles from the bonded deformable and resilient sheets, the separable dispenser/spreader articles each including one of the blister-shaped sealed containers and further each including a wide end forming a blade and a narrow end forming part of the sealed container, the wide end of each adjacent separable article being located near the narrow end on the adjacent separate article to provide a dense arrangement of articles on the deformable and resilient sheets prior to separation.

* * * * *